US005988412A

United States Patent [19]

Minnette et al.

[11] Patent Number: 5,988,412

[45] Date of Patent: Nov. 23, 1999

[54] SAFETY CLOSURE HAVING AN INTERNAL LOCKING LUG

[75] Inventors: Jeffrey C. Minnette, Evansville; Clayton L. Robinson, Newburgh, both of Ind.

[73] Assignee: Rexam Plastics, Inc., Evansville, Ind.

[21] Appl. No.: 08/992,422

[22] Filed: Dec. 17, 1997

[51] Int. Cl.[6] ..... B65D 41/04; B65D 55/12

[52] U.S. Cl. ..... 215/216; 215/206; 215/221; 215/330; 215/331

[58] Field of Search ..... 215/206, 213, 215/216, 217, 221, 222, 45, 331, 321, 330; 220/281

[56] References Cited

U.S. PATENT DOCUMENTS

| | | | |
|---|---|---|---|
| 1,863,796 | 6/1932 | Jackson et al. | 215/252 |
| 2,134,178 | 10/1938 | Esposito | 215/252 |
| 2,414,420 | 1/1947 | Sebell | 215/252 |
| 3,578,192 | 5/1971 | Sonne | 215/221 |
| 3,603,470 | 9/1971 | Armour | 215/213 |
| 3,750,821 | 8/1973 | Sourbet | 215/252 |
| 3,770,153 | 11/1973 | Gach et al. | 215/216 |
| 3,984,021 | 10/1976 | Uhlig | 215/217 X |
| 4,331,247 | 5/1982 | Mumford | 215/216 |
| 4,479,585 | 10/1984 | Sandhaus | 215/330 X |
| 4,613,063 | 9/1986 | Wright | 222/153.14 |
| 4,752,014 | 6/1988 | House et al. | 215/216 |
| 4,993,570 | 2/1991 | Jullian et al. | 215/44 X |
| 5,238,152 | 8/1993 | Maas et al. | 222/153.09 |
| 5,394,999 | 3/1995 | Krall | 215/330 X |
| 5,727,703 | 3/1998 | Fuchs | 215/216 X |
| 5,772,546 | 3/1998 | Briere | 215/221 X |

*Primary Examiner*—Stephen P. Garbe
*Assistant Examiner*—Niki M. Eloshway
*Attorney, Agent, or Firm*—Middleton & Reutlinger; John F. Salazar

[57] ABSTRACT

A cap having a top wall and at least one circumferentially extending sidewall having an inner surface with internal threads therealong and a terminating bottom edge of the sidewall defining an open end opposite to the top wall. The terminating edge is provided with an inwardly extending locking lug for engaging with an outwardly extending tab on a threadable neck of a container. The cap may be of double wall construction with an outer wall and an inner wall spaced therefrom wherein the threadable connections for the neck of a container are on the inner surface of the inner wall and the locking lug is on the terminating edge of the outer wall. A window is also provided along the terminating edge of the outer wall, the window being in visible alignment with the locking tab.

20 Claims, 4 Drawing Sheets

SAFETY CLOSURE HAVING AN INTERNAL LOCKING LUG

BACKGROUND OF THE INVENTION

This invention relates to safety closures for use on containers to prevent easy access to the contents therein by particularly small children and more particularly relates to a safety closure having an internal locking lug for engagement with outwardly extending locking tabs on the neck of a container.

Various types of locking mechanisms are known for securing closures or caps onto containers which are used for medicines and/or toxic substances. The primary objective of such locking mechanisms is to prevent young children from removing the closure from the container and thereby being exposed to the medicines or toxic substances therein. There are a number of safety disclosures taught in the prior art for the specific use of preventing easy removal by small children with access to the containers. For example, U.S. Pat. No. 3,770,153 teaches a safety closure which teaches a cap with an internal threaded wall portion with downwardly protruding lugs on the lower edge of the wall for mating relation with a lug recess on a container neck whereby continued rotation of the cap leads the lug into the recess thereby releasibly locking the cap upon the container neck and unlocking is accomplished by applying an inward squeezing force to the cap or portion of the cap to flex the lug outwards to disengage the lugs from the lug recess. However, in many of these prior art references teaching internal locking lugs, the user is unable to observe a lock/unlock function. And, in many cases, because of the inability to see the locking and unlocking functions of the cap with the neck of the container, the cap may not be rotated sufficiently to place the locking lug and locking recess or tab in a locking position.

SUMMARY OF THE INVENTION

An object of the present invention is to provide a safety closure for a container cap wherein the cap contains internal threads and at least one inwardly extending locking lug for mating relation with an outwardly protruding locking tab of the neck of a container.

Another object of the present invention is to provide an internal flapper type locking lug at the bottom of a cap sidewall which is deflected outwardly in an unlocking position by pushing inwardly at the cap bottom 90° away from the locking lug.

A further object of the present invention is to provide a window at the locking lug location so that the user can observe a locked/unlocked function while still maintaining the overall general aesthetics of a smooth wall appearance at the lock position.

More particularly, the present invention provides a cap for a container having a threadable neck and at least one outwardly extending stop tab on the neck positioned below the terminating end of the threads on the container neck, the cap comprising a top wall having at least one circumferentially extending sidewall around an outer periphery of said top wall, the circumferentially extending sidewall having an inner surface; the at least one sidewall is provided with a lower terminating circumferentially extending bottom portion defining an open end of said cap opposite said top wall; a flexible locking lug integral with said bottom sidewall portion, said locking lug extending inwardly therefrom and engageable with the outwardly extending stop tab on said neck; and, the lower sidewall portion including a window therein at the location of said locking lug whereby a locking/unlocking position is visible through said window.

Further objects and advantages of this invention will appear from the following description and appended claims, reference being had to the accompanying drawings forming a part of the specification wherein like reference characters designate corresponding parts into several views.

DETAILED DESCRIPTION OF THE PREFERRED EMBODIMENT

Figure 1:
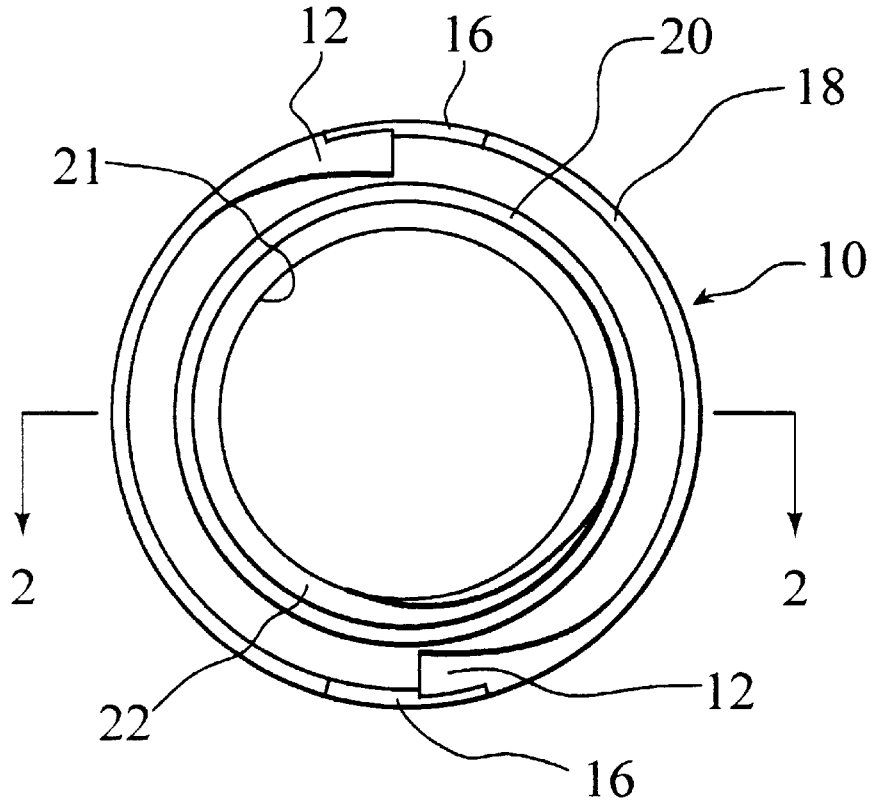
FIG. 1 is a bottom view of one preferred cap of the present invention.
Figure 2:
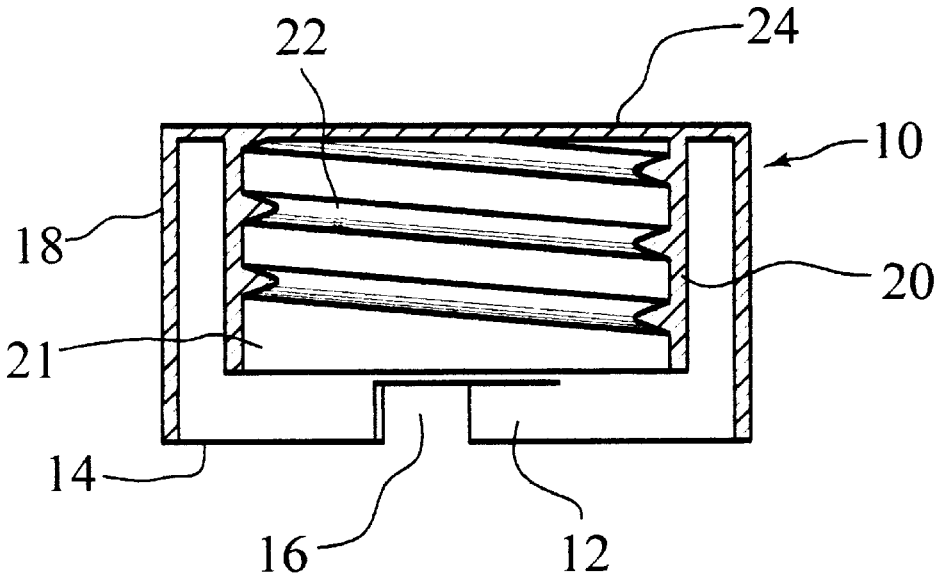
FIG. 2 is a sectional view of FIG. 1 taken along lines 2—2.
Figure 5:
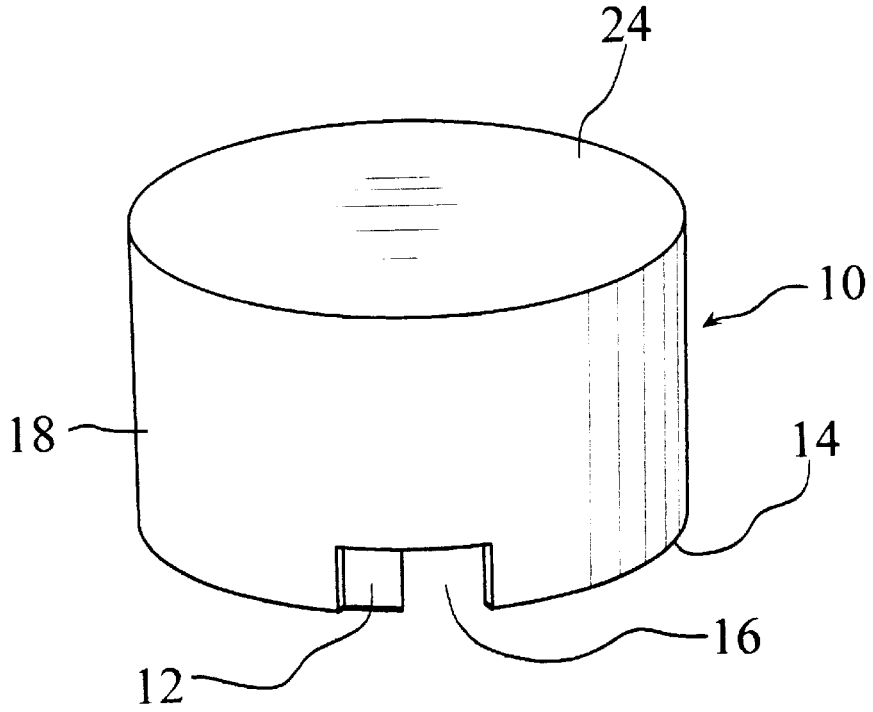
FIG. 5 is a perspective view of the cap of FIG. 1.

As best shown in FIGS. 1, 2, and 5, a cap 10 is provided with a top wall 24, an outer circumferentially extending side wall 18 and an inner circumferentially extending side wall 20 spaced a preselected distance inwardly from the outer wall 18. The outer wall 18 is provided with a lower circumferentially extending terminating edge 14 with at least one slot 16 cut therein. At the location of the slot 16, the lower terminating edge 14 is thicker than the remaining portion of the edge 14 and is provided with an inwardly extending flexible locking lug 12. The cut out slot 16 provides a window for the observation of the locking lug 12 when in a locking or unlocking position as discussed hereinafter. Inner wall 20 is provided with an inner surface 21 having a circumferentially extending threaded portion 22 therealong. As best shown in FIG. 1, a preferred arrangement includes two locking lugs 12 with aligned observation windows 16 on opposite sides of the outer sidewall 18.

Figure 3:
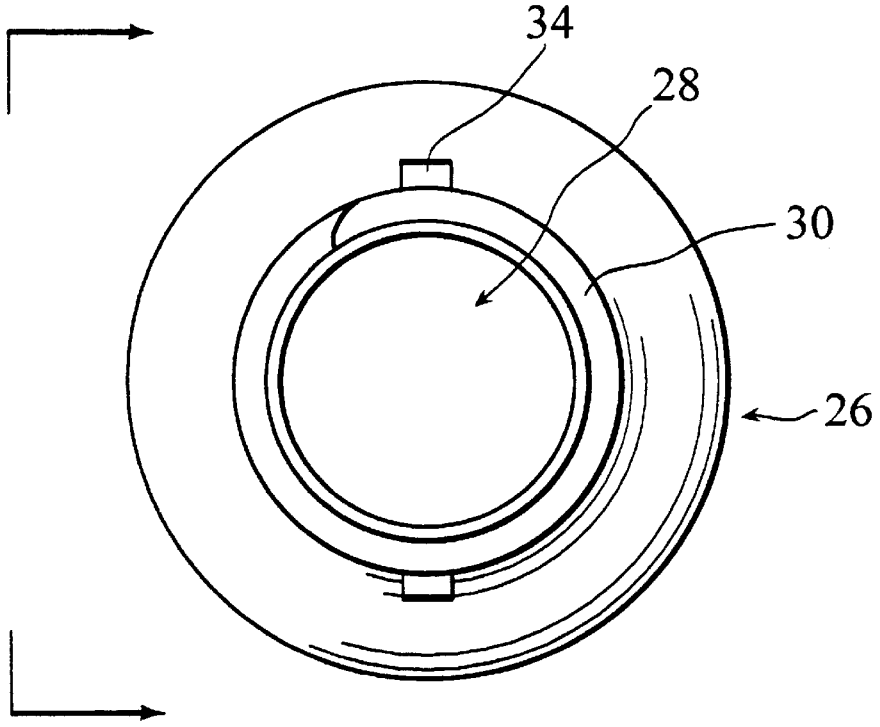
FIG. 3 is a top view of a container usable with a cap of the present invention.
Figure 4:
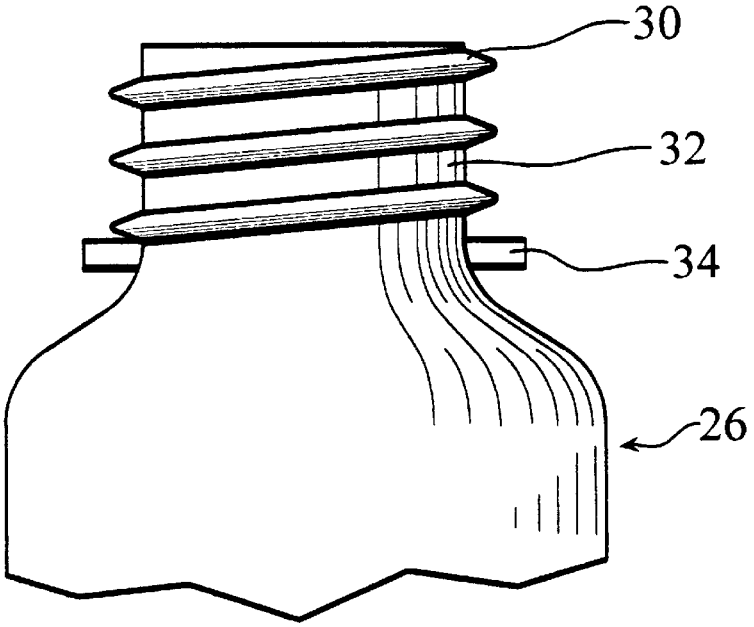
FIG. 4 is a side view of a container of FIG. 3.

As best shown in FIGS. 3 and 4, a container 26 to receive the cap 10 thereon is provided with an upper neck portion 32 and external threads 30 to receive in threading relation internal threaded portion 22 of inner wall 20 and on opposite sides of the neck 32 are outwardly extending tabs 34 positioned for engagement with the flexible locking lugs 12 when the cap 10 has been threadably received by the neck 32.

Figure 6:
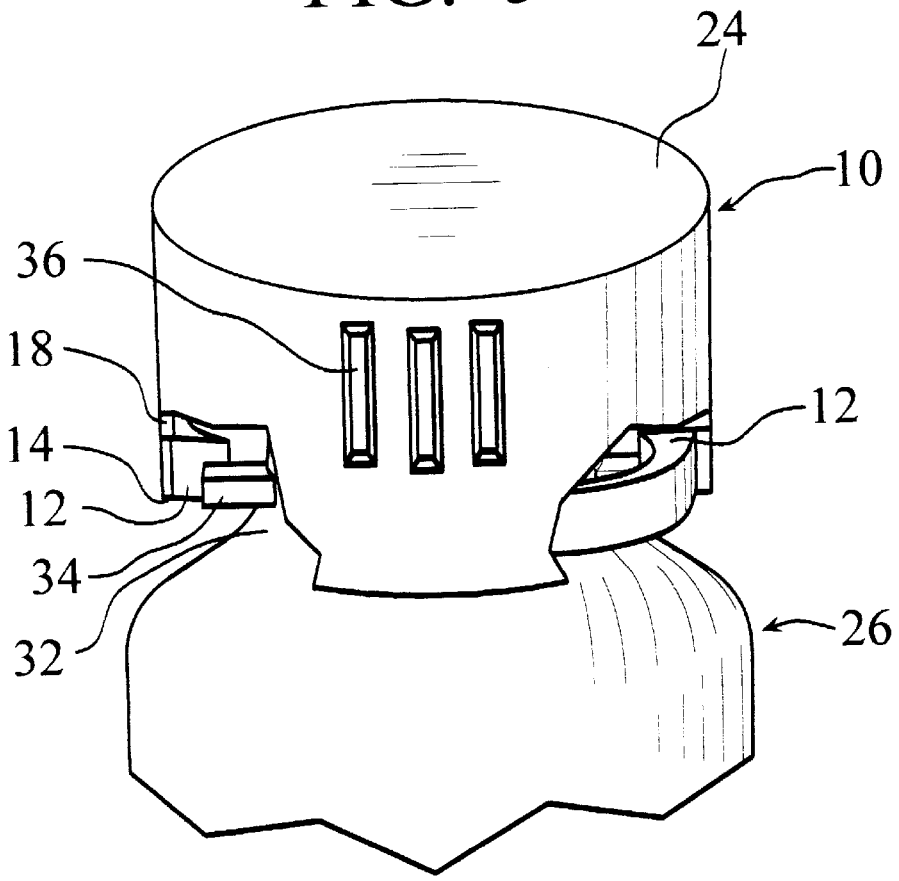
FIG. 6 is a perspective view of a cap of FIG. 1 shown in a closure relationship with a container with selected portions in cut-away.

As shown in FIG. 6, the cap 10 is received by the neck 32 of container 26 and the locking lugs 12 are engagingly received by the tabs 34. Also shown in FIG. 6, at a circumferential position 90° from the locking lugs 12 are squeeze points 36 (only one being shown) which are positions for "squeezing" with the fingers the portions of the sidewall 18 for unlocking the locking lugs 12 from their locked engagement with the tabs 34. Upon "squeezing" at the squeeze points 36 the flexible cap 10 extends outwardly at the location of the lugs 12 and upon extending outwardly the locking lugs 12 disengage from their locked position; and, upon turning counter-clockwise, while holding the squeeze point momentarily, the locking lug 12 passes over the tabs 34 and by further counter- clockwise rotation the cap 10 may then be removed from the neck 32 of the container 26.

Figure 7:
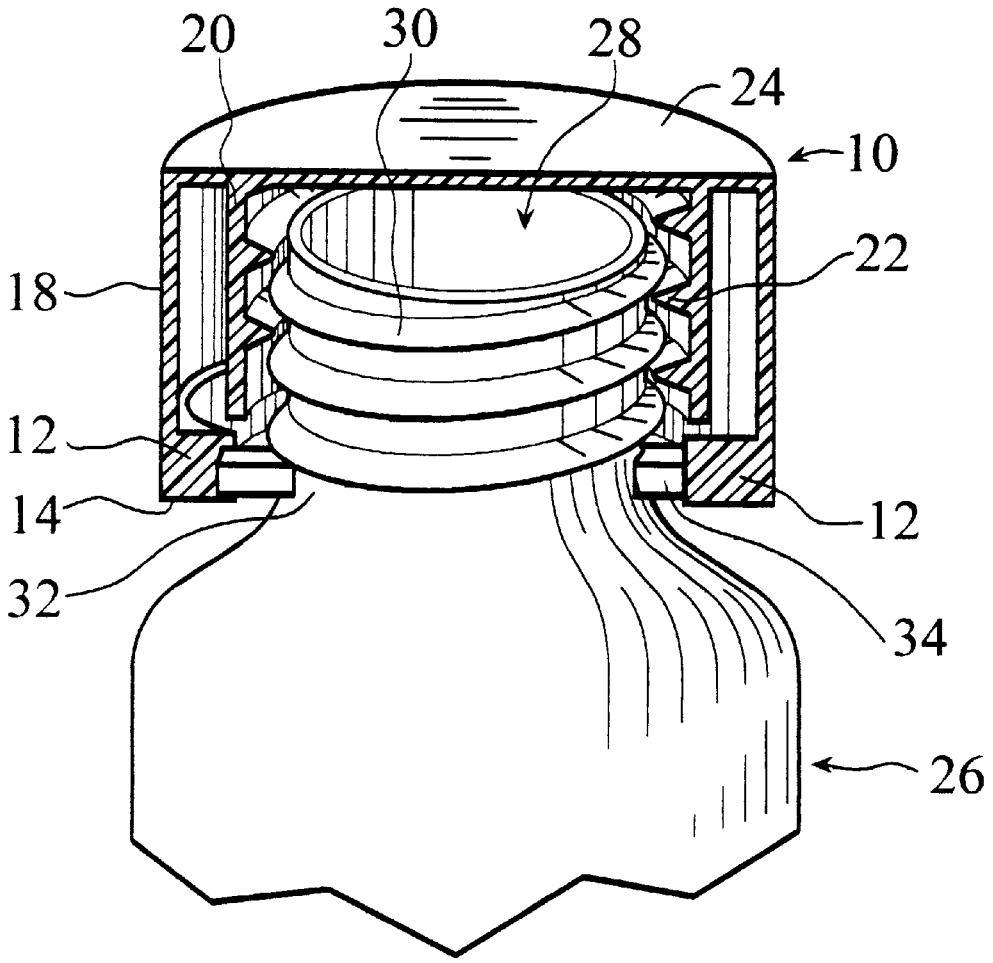
FIG. 7 is a side view in elevation of FIG. 6 with selected parts in section of the cap of FIG. 1; and, FIG. 8 is a side view in elevation with parts in section of another cap embodying the present invention.

And, as shown in FIG. 7, the container 26 is provided with an open top 28 for the dispensing of tablets, liquids, or the like from the container 26.

As shown in FIGS. 1–7, a double wall cap allows for the inner wall 20 to be of a greater thickness than the outer wall 18 thereby strengthening the inner wall in its threadable relation with a neck 32. And, the thinner outer wall 18 requires very little strength to squeeze the outer wall 18 thereby forcing the locking lugs 12 to an unlocking position. This type of double wall arrangement is particularly useful for older or senior citizens with relatively little strength in their hands and fingers and still provides a secured container when in the hands of small children or the like.

In a preferred cap, the locking lug 12 is generally prepared by making the outer wall of the terminating edge 14 thicker at the position of the locking lugs 12 and then flashing away the outer portion of the terminating edge 14 at the thickened portion. The flashing extends only a selected distance inwardly to provide a cut-out portion along the outer surface at the lugs 12 and also provides an opening between the terminating end of the lug and the flashed away portion thereby defining a window for the locking lugs 12 at the thickened portion of the bottom edge 14 of the outer wall 18.

In operation and as best shown in FIG. 7, cap 10 having double walls 18 and 20 is placed upon the neck 32 of the container 26 and turned clockwise. The clockwise rotation of the cap provides threadable engagement between the threads 22 and 30 thereby moving the cap 10 downwardly until the flexible locking lugs 12 pass over the outwardly extending tabs 34. Upon the lugs 12 passing over the tabs 34, the cap is secured onto the neck 32 of the container 26. The only way to remove the cap 10 from the container neck 32 is to press inwardly at the squeeze points 36, as shown in FIG. 6, so that the locking lugs 12 are forced outwardly beyond the terminating ends of the tabs 34 and simultaneously turning the cap 12 in counter-clockwise rotation sufficient for the locking lugs 12 to pass over the terminating ends of the tabs 34. Once the locking lugs 12 have cleared the tabs 34 the cap 10 may then be removed by rotating the cap counter-clockwise until the threads 22 are disengaged from threads 30.

Figure 8:
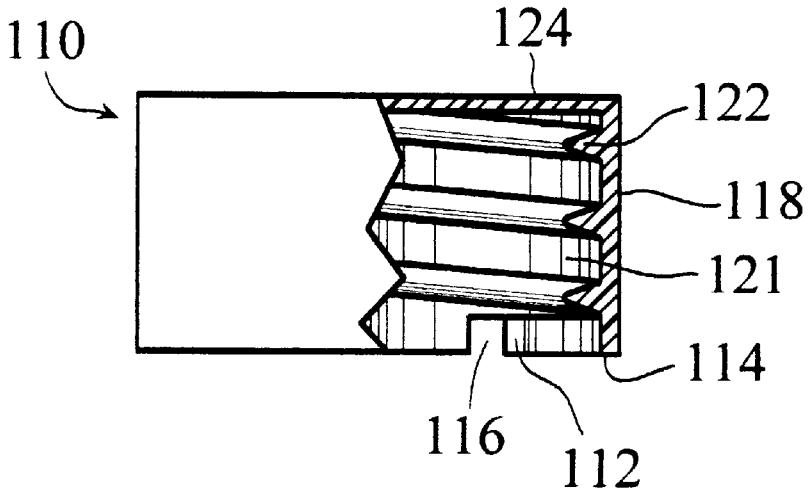

In FIG. 8 is shown another embodiment of the present invention wherein only a single wall cap 110 is shown with a top wall 124 and a circumferentially extending sidewall 118. The sidewall 118 is provided with an inner surface 121 with inwardly extending threads 122 circumferentially extending therearound. The sidewall 118 is also provided with a lower terminating edge 114 which includes an inwardly extending flexible locking lug 112 similar to the locking lug 12, as discussed previously, and a slot or window 116 for viewing the locking lug 112 when in a locking or unlocking position.

It is realized that various changes in the details, materials of construction, steps and arrangement of parts which have been described herein and shown in the drawings in order to explain the nature of the invention, may be made by those skilled in the art without departing from the principals and scope of the invention as expressed in the claims appended hereto.

What is claimed is:

1. A flexible cap for a container having a threadable neck and at least one outwardly extending stop tab on said neck positioned below the threads of the neck, the cap comprising:

a top wall having at least one circumferentially extending sidewall extending downwardly therefrom, said at least one sidewall having an inner surface with internal threads therearound;

a circumferentially extending terminating edge of said at least one sidewall defining an open end opposite said top wall;

at least one window at said terminating edge; and, a flexible locking lug unitary with said terminating edge and radially extending inwardly therefrom, said locking lug being inwardly of and visible through said window.

2. The cap of claim 1 having two flexible locking lugs in diametrically opposed positions along said terminating edge of said cap.

3. The cap of claim 2, said cap having squeeze points located along said terminating edge 90° from said locking lugs.

4. The cap of claim 1 wherein said terminating edge is thicker at said window and said lug than the remaining portion of said terminating edge, the remaining portion of said terminating edge being of substantially uniform thickness.

5. The cap of claim 1, said locking lug being spaced downwardly from a terminating end of said internally extending threads.

6. A flexible cap for a container having a threadable neck and at least one outwardly extending stop tab on said neck positioned below threads on said neck, said cap comprising:

a top wall having an inner sidewall and an outer sidewall extending downwardly therefrom, said inner sidewall being spaced a preselected distance from said outer sidewall, said inner sidewall having an inner surface with internal threads therealong;

said outer sidewall having a circumferentially extending first terminating edge extending beyond a second bottom edge of said inner sidewall, said first terminating edge defining an open end opposite to said top wall;

at least one window in said first terminating edge; and, a flexible locking lug unitary with said first terminating edge and extending inwardly therefrom, said locking lug being spaced inwardly of and visible through said window.

7. The cap of claim 6 having two flexible locking lugs in diametrically opposed positions along said first terminating edge of said cap.

8. The cap of claim 7, said cap having squeeze points located along said first terminating edge 90° from said locking lug.

9. The cap of claim 6 wherein said first terminating edge is thicker at said window and said lug than the remaining portion of said first terminating edge, the remaining portion of said first terminating edge being of substantially uniform thickness.

10. The cap of claim 6, said locking lug being spaced downwardly from a terminating end of said internally extending threads.

11. A safety closure comprising: a container and a flexible cap, said container having a threadable neck and at least one stop tab on the neck positioned below threads on said neck, the cap having a top wall with at least one circumferentially extending sidewall, said sidewall having an inner surface with internal threads therealong in mating relation with said threads on said neck, said at least one circumferentially extending wall having a circumferentially extending terminating edge defining an open end opposed to the top wall of said cap, the terminating edge having at least one window therein and a flexible locking lug unitary with the terminating edge and extending inwardly therefrom, said locking lug being spaced inwardly of and visible and through said window.

12. The safety closure of claim 11 having two flexible locking lugs in diametrically opposed positions along said terminating edge of said cap.

13. The cap of claim 12, said safety closure having squeeze points located along said terminating edge 90° from said locking lug.

14. The safety closure of claim 11 wherein said terminating edge is thicker at said window and said lug than the remaining portion of said terminating edge, the remaining portion of said terminating edge being of substantially uniform thickness.

15. The safety closure of claim 11, said locking lug being spaced downwardly from a terminating end of said internally extending threads.

16. A safety closure comprising: a container and a flexible cap, said container having a threadable neck and at least one stop tab on the neck positioned below threads on said neck, the cap having a top wall with an inner sidewall and an outer sidewall extending downwardly therefrom, said inner sidewall being spaced a preselected distance from said outer sidewall, said inner sidewall having an inner surface with internal threads therealong; said outer sidewall having a circumferentially first terminating edge extending beyond a second bottom edge of said inner sidewall, said first terminating edge defining an open end opposite to said top wall; the first terminating edge having at least one window therein and a flexible locking lug unitary with the terminating edge and extending inwardly therefrom, said locking lug being spaced inwardly of and visible through said window.

17. The safety closure of claim 16 having two flexible locking lugs in diametrically opposed positions along said first terminating edge of said cap.

18. The safety closure of claim 17, said cap having squeeze points located along said first terminating edge 90° from said locking lug.

19. The safety closure of claim 16 wherein said first terminating edge is thicker at said window and said lug than the remaining portion of said first terminating edge, the remaining portion of said first terminating edge being of substantially uniform thickness.

20. The safety closure of claim 16, said locking lug being spaced downwardly from a terminating end of said internally extending threads.

* * * * *

UNITED STATES PATENT AND TRADEMARK OFFICE

CERTIFICATE OF CORRECTION

PATENT NO. : 5,988,412

DATED : November 23, 1999

INVENTOR(S) : Minnette et al

It is certified that error appears in the above-identified patent and that said Letters Patent is hereby corrected as shown below:

Claim 13, col. 5, line 8, change "cap" to --safety closure --.

Signed and Sealed this

Twentieth Day of March, 2001

Nicholas P. Godici

*Attest:*

NICHOLAS P. GODICI

*Attesting Officer*

*Acting Director of the United States Patent and Trademark Office*